US006848773B1

(12) United States Patent
Hoisington et al.

(10) Patent No.: US 6,848,773 B1
(45) Date of Patent: Feb. 1, 2005

(54) PIEZOELECTRIC INK JET PRINTING MODULE

(75) Inventors: Paul A. Hoisington, Norwich, VT (US); Marlene M. McDonald, Enfield, NH (US); Nathan P. Hine, South Strafford, VT (US); Jill Ann Hanson, Charlestown, NH (US); Melvin L. Biggs, Norwich, VT (US); Edward R. Moynihan, Plainfield, NH (US)

(73) Assignee: Spectra, Inc., Lebanon, NH (US)

( * ) Notice: Subject to any disclaimer, the term of this patent is extended or adjusted under 35 U.S.C. 154(b) by 0 days.

(21) Appl. No.: 09/662,902

(22) Filed: Sep. 15, 2000

(51) Int. Cl.[7] ..... B41J 2/045; H04R 17/00
(52) U.S. Cl. ..... 347/68; 29/25.35
(58) Field of Search ..... 29/25.35; 347/62, 347/68, 70, 47, 59, 55, 11, 10; 216/27, 16, 51; 427/100

(56) References Cited

U.S. PATENT DOCUMENTS

| | | | | |
|---|---|---|---|---|
| 4,891,654 A | | 1/1990 | Hoisington et al. | |
| 5,265,315 A | | 11/1993 | Hoisington et al. | |
| 5,308,442 A | | 5/1994 | Taub et al. | 216/27 |
| 5,459,501 A | * | 10/1995 | Lee et al. | 347/68 |
| 5,500,988 A | | 3/1996 | Moynihan et al. | |
| 5,518,952 A | | 5/1996 | Vonasek et al. | 438/21 |
| 5,581,561 A | * | 12/1996 | Luckett | 714/709 |
| 5,605,659 A | | 2/1997 | Moynihan et al. | |
| 5,619,234 A | * | 4/1997 | Nagato et al. | 347/55 |
| 5,640,184 A | | 6/1997 | Moynihan et al. | |
| 5,657,063 A | | 8/1997 | Takahashi | |
| 5,793,394 A | | 8/1998 | Kato | |
| 5,818,473 A | * | 10/1998 | Fujii et al. | 347/11 |
| 5,870,121 A | * | 2/1999 | Chan | 347/59 |
| 5,997,122 A | * | 12/1999 | Moriyama et al. | 347/11 |
| 6,037,707 A | | 3/2000 | Gailus et al. | |
| 6,156,030 A | * | 12/2000 | Neev | 606/10 |
| 6,299,288 B1 | * | 10/2001 | Abeywardane et al. | 347/47 |
| 6,560,833 B2 | * | 5/2003 | Nishi et al. | 29/25.35 |
| 6,568,797 B2 | * | 5/2003 | Yamauchi et al. | 347/70 |
| 6,578,953 B2 | * | 6/2003 | Kitahara et al. | 347/68 |

FOREIGN PATENT DOCUMENTS

| | | |
|---|---|---|
| EP | 0 273 282 A | 7/1988 |
| EP | 0 896 879 A2 | 2/1999 |

OTHER PUBLICATIONS

Sinha et al., J. Appl Phys. 49:2756 (1978).
Dunn, J. Electrochemical Soc. 128:1555 (1981).

* cited by examiner

*Primary Examiner*—K. Feggins
(74) *Attorney, Agent, or Firm*—Fish & Richardson P.C.

(57) ABSTRACT

A piezoelectric ink jet printing module has a semiconductive material on a surface of a piezoelectric element of the module.

22 Claims, 5 Drawing Sheets

PIEZOELECTRIC INK JET PRINTING MODULE

TECHNICAL FIELD

This invention relates to an ink jet printing module.

BACKGROUND

An ink jet printing module ejects ink from an orifice in the direction of a substrate. The ink can be ejected as a series of droplets generated by a piezoelectric ink jet printing module. A particular printing module can have 256 jets in four groups of 64 jets each. A piezoelectric ink jet printing module includes a module body, a piezoelectric element, and electrical contacts that driving the piezoelectric element. Typically, the module body is a rectangular member into the surfaces of which are machined a series of ink channels that serve as pumping chambers for the ink. The piezoelectric element can be disposed over the surface of the body to cover the pumping chambers in a manner to pressurize the ink in the pumping chambers to eject the ink.

The properties of the piezoelectric element can affect the jetting properties of the printing module. For example, the volume of the drop of ink that is produced by the fire pulse can depend on the properties of each ink jet in the printing module. The droplet volume and velocity of the droplets can affect the quality of images produced by the droplets. By selectively ejecting ink droplets of a desired size at a desired velocity and at desired locations, or pixels, highly accurate images can be produced.

SUMMARY

In general, the invention features a piezoelectric ink jet printing module having a semiconductive material on a surface of a piezoelectric element of the module. The semiconductive material can be a coating. The semiconductive nature of the material can help bleed charge generated from heating and cooling the piezoelectric element away from the element. This can improve the stability of the module during heating and cooling cycles that can be encountered during printing. The semiconductive material increases the charge diffusivity of a surface of the piezoelectric element. By increasing the charge diffusivity in the area near an electrical contact, sufficient voltage can be applied to pole or depole the piezoelectric element, or a portion of it. The ability to pole or depole the piezoelectric element, or a portion thereof, can simplify the manufacture of the module and can allow the droplet ejection properties to be modified for a single jet.

In one aspect, the invention features an ink jet module including a piezoelectric element having a semiconductive material on a surface of the piezoelectric element. The semiconductive material can bleed pyroelectric charge from the piezoelectric element. The semiconductive material can be a coating on the piezoelectric element.

In another aspect, the invention features an ink jet print head including a plurality of ink jet modules.

In another aspect, the invention features a method of manufacturing an ink jet module. The method includes comprising placing a semiconductive material on a surface of a piezoelectric element. Placing can include coating the semiconductive material on the surface of the piezoelectric element. The method can also include contacting an electrical contact with the piezoelectric element. The electrical contact can contact the semiconductive material.

In another aspect, the invention features a method of reducing ink velocity degradation in an ink jet module during thermal cycling. The method includes placing a semiconductive material on a surface of a piezoelectric element, which can include coating the semiconductive material on the surface of the piezoelectric element.

In another aspect, the invention features a method of poling a piezoelectric ink jet module. The poling method includes assembling a piezoelectric ink jet module including a semiconductive material on a surface of a piezoelectric element. The piezoelectric element has electrical contacts in contact with the semiconductive material on the surface of the piezoelectric element. The electrical contacts are arranged to activate the piezoelectric element. A poling voltage is applied across the semiconductive material and the piezoelectric element for sufficient time to pole the piezoelectric element.

In another aspect, the invention features a method of modifying performance of a jet in an ink jet printing module. The method includes applying a modification voltage to a jetting region of a piezoelectric element of the ink jet printing module to alter poling of the piezoelectric element in the jetting region. The jetting region can include an electrical contact contacting a semiconductive material on a surface of the piezoelectric element in the jetting region. The modification voltage can be applied to the electrical contact. The module can include a plurality of jets and each jet having a jetting region including an electrical contact contacting a semiconductive material on a surface of the piezoelectric material. The method can include monitoring the jet of the module for ink drop size or ink drop velocity and selecting a modifying voltage to adjust toe ink drop size or the ink drop velocity.

The semiconductive material has a conductivity greater than the conductivity greater than piezoelectric element. When the semiconductive material forms a coating to prevent pyroelectric depoling during thermal cycling, the coating of semiconductive material is conductive enough to discharge the charge build up on the surface of the piezoelectric material during cooling time and resistive enough to maintain resolution of fields applied at each electrodes for the duration of the field application. The semiconductive material can have a resistivity of 5000 megaohms per square or less, preferably 1000 megaohms per square or less, and more preferably 500 megaohms per square or less. The semiconductive material can have resistivity of 0.1 megaohms per square or greater, preferably 1 megaohms per square or greater, and more preferably 10 megaohms per square or greater. In certain embodiments, the semiconductive material has a resistivity of between 11 megaohms per square and 500 megaohms per square.

The semiconductive material can include a doped insulator. The doped insulator can be selected to have a particular resistivity. Preferably, the semiconductive material can be derived from alumina, silicon nitride, or neodynium oxide. In certain embodiments, the semiconductive material is derived from silicon nitride and the piezoelectric element is lead zirconium titanate.

The ink jet module can include an ink channel. The piezoelectric element can be positioned to subject ink within the channel to jetting pressure. Electrical contacts can be arranged to activate the piezoelectric element. The module can include a series of channels. Each of the channels can be covered by a single piezoelectric element. In certain aspects, all of the channels are covered by a single piezoelectric element. The ink jet module can be subjected to heating and cooling cycles.

The details of one or more embodiments of the invention are set forth in the accompanying drawings and the description below. Other features, objects, and advantages of the invention will be apparent from the description and drawings, and from the claims.

DETAILED DESCRIPTION

The piezoelectric ink jet module includes a piezoelectric element having a semiconductive material on a surface of the element. In general, the module includes a piezoelectric element positioned over jetting regions of a body. The jetting regions can be portions of pumping chambers within the body. A polymer, such as flex print, can seal the pumping chambers and can position the electrical contacts, such as electrodes, on a surface of the piezoelectric element. The piezoelectric element spans each jetting region. When a voltage is applied to an electrical contact, the shape of the piezoelectric element change in a jetting region, thereby subjecting the ink within the corresponding pumping chamber to jetting pressure. The ink is ejected from the pumping chamber and deposited on a substrate. Preferably, the electrical contacts also contact the semiconductive material.

Figure 1A:
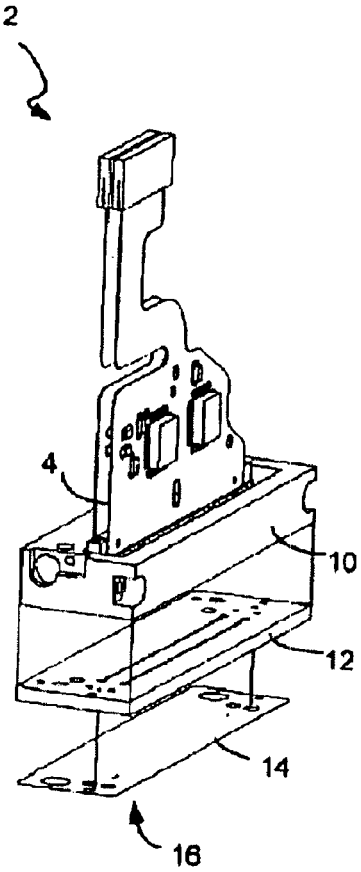
FIGS. 1A and 1B are schematic diagrams depicting a piezoelectric ink jet printing module.
Figure 1B:
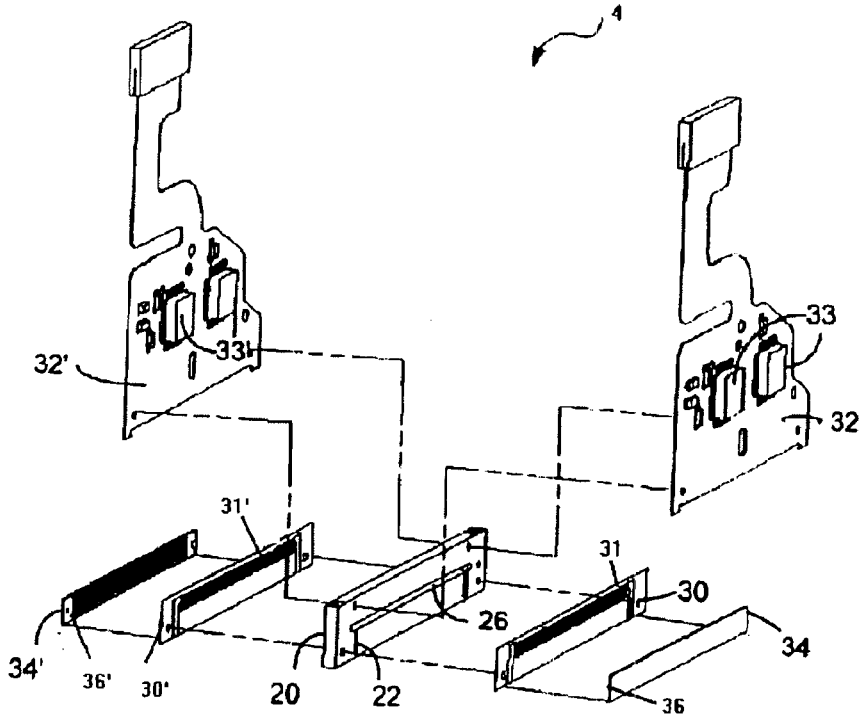
Figure 2:
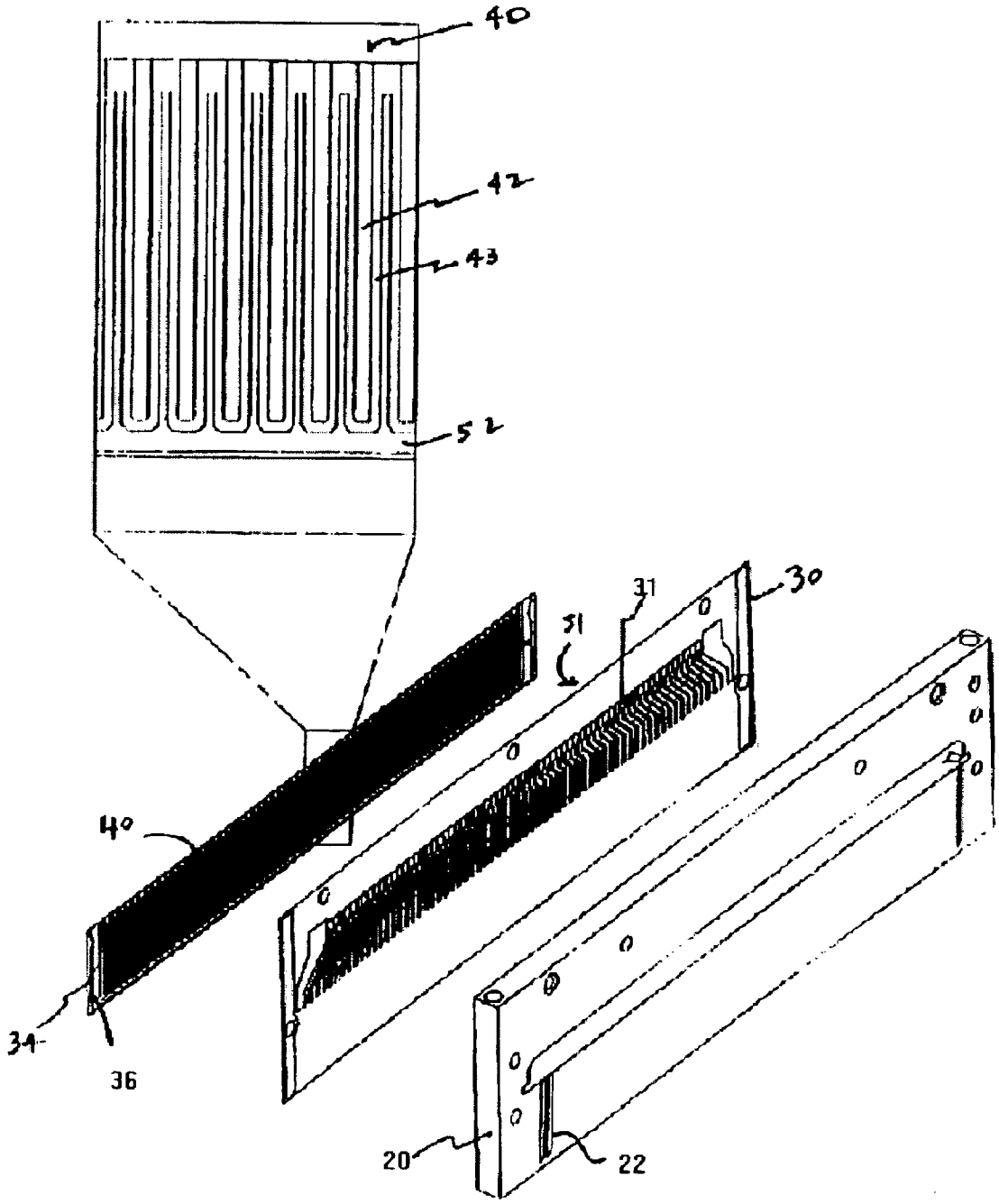
FIG. 2 is a schematic diagram depicting a portion of a piezoelectric ink jet printing module.

One example of a piezoelectric ink jet printing module is a shear mode module, such as the module described in U.S. Pat. No. 5,640,184, the entire contents of which is incorporated herein by reference. The electrical contacts in a shear mode module can be located on the side of the piezoelectric element adjacent to the ink channel. Referring to FIGS. 1A, 1B and 2, piezoelectric ink jet head 2 includes one or more modules 4 which are assembled into collar element 10 to which is attached manifold plate 12, and orifice plate 14. Ink is introduced into module 4 through collar 10. Module 4 is actuated to eject ink from orifices 16 on orifice plate 14. An exemplary ink jet head is available as Model CCP 256/300 HOT MELT PILG HD (Spectra, Inc., Hanover, N.H.).

Ink jet module 4 includes body 20, which can be made from materials such as sintered carbon or a ceramic. A plurality of channels 22 are machined or otherwise manufactured into body 20 to form pumping chambers. Ink passes through ink fill passage 26, which is also machined into body 20, to fill the pumping chambers. Opposing surfaces of body 4 are covered with flexible polymer films 30 and 30' that include a series of electrical contacts 31 and 31' arranged to be positioned over the pumping chambers in body 20. Electrical contacts 31 and 31' are connected to leads, which, in turn, can be connected to flex prints 32 and 32' which include driver integrated circuits 33 and 33'. The films 30 and 30' can be flex prints (e.g., KAPTON, available from Advanced Circuit Systems, Franklin, New Hampshire). Films 30 and 30' are sealed to body 20 by a thin layer of epoxy. Film 30 and flex print 32 can be a single unit (not shown), or two units as shown. The piezoelectric elements 34 and 34' have semiconductive coatings 36 and 36' on at least one surface of each element. The semiconductive coating can be applied by methods such as sputtering, evaporating, or chemical vapor deposition on the surface of the piezoelectric elements.

Figure 6A:
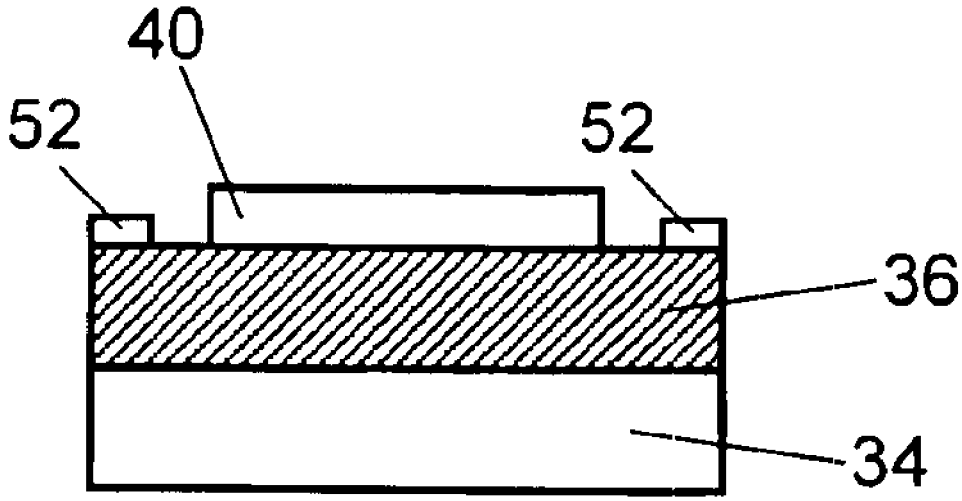
FIGS. 6A and 6B are schematic diagrams depicting a piezoelectric element.
Figure 6B:
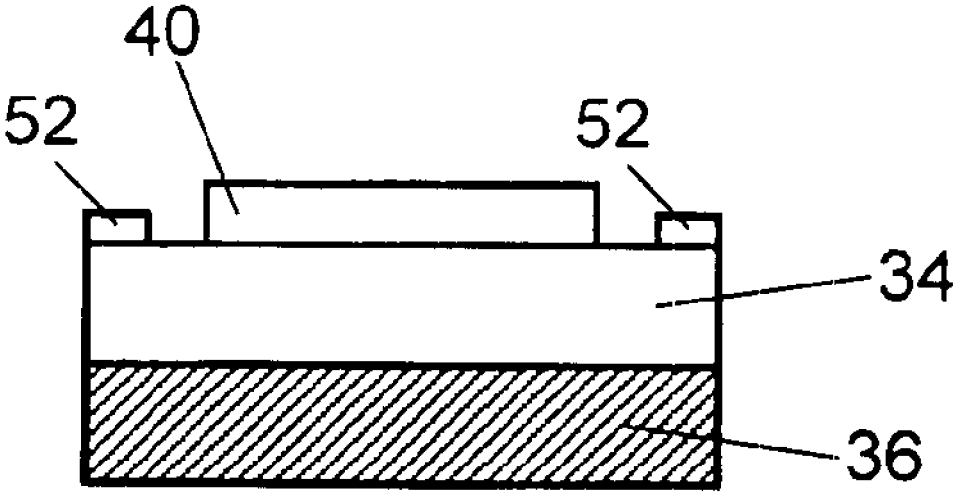

Referring to FIG. 2, and FIGS. 6A and 6B, piezoelectric element 34 registers over film 30. Piezoelectric element 34 has electrodes 40 on the side of the piezoelectric element 34 that contacts film 30. Electrodes 40 register with electrical contacts 31 on side 51 of film 30, allowing the electrodes to be individually addressed by a driver integrated circuit. Electrodes 40 can be disposed on semiconductive coating 36 on a surface of piezoelectric element 34. Alternatively, electrodes 40 are disposed on one surface of piezoelectric element 34 and semiconductive coating 36 is disposed on an opposing surface. Electrodes 40 can be formed by chemically etching away conductive metal that has been deposited onto the surface of the piezoelectric element. Suitable methods of forming electrodes are also described in U.S. Pat. No. 6,037,707, which is herein incorporated by reference in its entirety. The electrode can be formed of conductors such as aluminum, titanium-tungsten, nickel-chrome, or gold. Each electrode 40 is placed and sized to correspond to a channel 22 in body 4 to form a pumping chamber. Each electrode 40 has elongated region 42, having a length and width slightly narrower than the dimensions of the pumping chamber such that gap 43 exists between the perimeter of electrodes 40 and the sides and end of the pumping chamber. These electrode regions 42, which are centered on the pumping chambers, are the drive electrodes that cover a jetting region of piezoelectric element 34. A second electrode 52 on piezoelectric element 34 generally corresponds to the area of body 20 outside channel 22, and, accordingly, outside the pumping chamber. Electrode 52 is the common (ground) electrode. Electrode 52 can be comb-shaped (as shown) or can be individually addressable electrode strips. The film electrodes and piezoelectric element electrodes overlap sufficiently for good electrical contact and easy alignment of the film and the piezoelectric element. The film electrodes extend beyond the piezoelectric element to allow for a soldered connection to the flex print 32 that contains the driving circuitry.

In an alternative embodiment (not shown), electrodes 40 can be deposited directly on film 30, which contacts semiconductive coating 36 on the surface of the piezoelectric element. This can promote effective electrical contact between the electrodes and the piezoelectric element. This can be accomplished, in part, by increasing the conductivity of the surface. This can simplify the manufacture of the module and allow a wide variety of electrode formation methods to be used.

The piezoelectric element can be a single monolithic lead zirconium titanate (PZT) member. The piezoelectric element drives the ink from the pumping chambers by displacement induced by an applied voltage. The displacement is a function of, in part, the poling of the material. The piezoelectric element is poled by the application of an electric field. A poling process is described, for example, in U.S. Pat. No. 5,605,659, which is herein incorporated by reference in its entirety. The degree of poling can depend on the strength and duration of the applied electric field. When the poling voltage is removed, the piezoelectric domains are aligned.

Subsequent applications of an electric field, for example, during jetting, can cause a shape change proportional to the applied electric field strength. Variations in the applied electric field in a direction opposing the polarization can cumulatively and continuously degrade the polarization. In addition, heating the piezoelectric material to the Curie point can cause depoling, or loss of polarization. Moreover, heating of the piezoelectric material can cause pyroelectric charge to build up on a surface of the piezoelectric element. The build up of pyroelectric charge can lead to voltage significant enough to depole the piezoelectric element. Depolarization can begin to occur at voltages as low as 200 volts. For example, a typical shear mode PZT device can generate a pyroelectric voltage of between 6 to 20 volts per degree Celsius, which can generate sufficient voltage to depolarize the piezoelectric element. Accordingly, the jetting performance of the ink jet module can be adversely affected.

A semiconductive coating on a surface of the piezoelectric element, preferably a surface opposite the location of the electrodes, can reduce or eliminate pyroelectric charge build up generated by thermal cycling. The semiconductive coating can bleed the pyroelectric charge away from the piezoelectric element. The semiconductive coating used to bleed pyroelectric charge from the piezoelectric element can be on a single surface of the element. If the coating is excessively insulating, it will not adequately bleed off the pyroelectric charge. If the coating is excessively conductive, it will prevent proper operation of the module, for example, during application of a 10 microsecond firing pulse. The semiconductive coating can have the desired resistivity at temperatures between 20° C. and 150° C. If the semiconductive coating is applied to poled PZT, the deposition temperature can be below 200° C. The semiconductive coating can be inert and durable. For example, the semiconductive material should be stable at elevated temperatures, for example up to 150° C. and should not react adversely with materials or components in contact with the semiconductive material.

More particularly, the charge diffusivity of the semiconductive coating can be sufficient to bleed the pyroelectric charge. The semiconductive material can have a diffusivity of greater than 0.006 $cm^2$/sec, preferably greater than 0.06 $cm^2$/sec, and less than 100 $cm^2$/sec, preferably less than 10 $cm^2$/sec. The diffusivity, $\alpha$, can be estimated from the thickness of the piezoelectric element, t, dielectric constant of the piezoelectric material, $\epsilon$, and the coating resistivity, $\rho$, by the formula:

$$\alpha = t/\rho\epsilon$$

For a PZT thickness of 0.25 mm, a coating resistivity of 100 megaohms per square, and PZT dielectric constant of $1600\times\epsilon_0$ (where $\epsilon_0$ is the permittivity constant), the resulting diffusivity is 1.7 $cm^2$/sec. When the coating resistivity is 10 megaohms per square, the resulting diffusivity is 17 $cm^2$/sec. For a typical PZT-based piezoelectric element, the coating can have a resistivity of less than 100 megaohms per square to properly bleed off the pyroelectric charge build up and the coating can have a resistivity of more than 10 megaohms per square to not adversely impact device performance.

Figure 3:
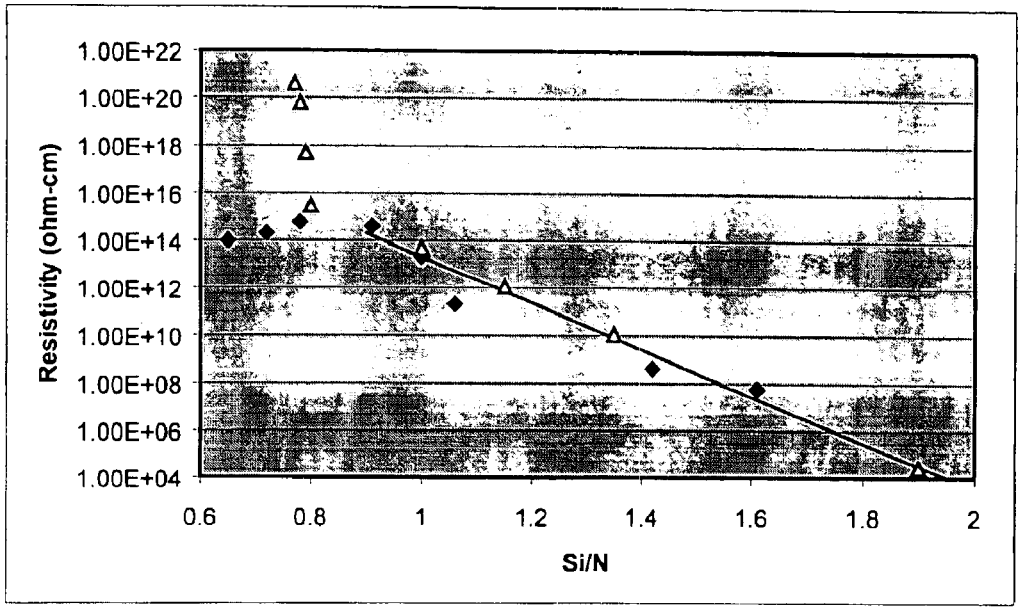
FIG. 3 is a graph depicting the resistivity of silicon nitride as the mole ratio of Si to N varies.

Suitable semiconductive materials that can be placed on a surface of the piezoelectric element include alumina-based materials, silicon nitride-based materials, and neodymium oxide based materials. The resistivity of these materials can be adjusted by adding dopants to the material. For example, the bulk resistivity of silicon nitride can be altered by adjusting the mole ratio of silicon to nitrogen, as depicted in FIG. 3. See, for example, H. Dun et al. J. Electrochemical Society 128:1555 (1981) and A. K. Sinha and T. E. Smith J. Applied Physics 49:2756 (1978). The resistivity of the coating, or surface resistivity, is the bulk resistivity divided by the thickness of the coating. The semiconductive material can be a contiguous layer on a surface of the piezoelectric element. The coating can have a thickness between 1000 and 10000 Angstroms, preferably between 2000 and 9000 Angstroms, and more preferably between 2500 and 7500 Angstroms.

The semiconductive coating can improve the contact between the piezoelectric element and electrodes on a polymer film contacting the coating. Patterning the electrodes on a PZT element can be an expensive process. Flex prints and circuit boards can be patterned less expensively. By bonding an electrode pattern on a polymer film, such as a flex print, to a piezoelectric element, costly electrode patterning on the piezoelectric surface can be avoided. Conductive particles can be added at the interface between the piezoelectric surface arid the electrodes to enhance electrical contact. A process of this type is described, for example, in U.S. Pat. No. 6,037,707, which is incorporated by reference. The coating is highly conductive in comparison to the underlying piezoelectric element surface. Thus, the electrical contact with electrodes on a polymer film can be improved. The semiconductive coating can reduce contact resistance and help spread the charge out over the surface of the piezoelectric element. For a PZT thickness of 0.25 mm, a coating resistivity of 10 megaohms per square, and dielectric constant of $1600\times\epsilon_0$, the diffusivity is 17 $cm^2$/sec. In one microsecond, the charge would spread a distance of about 0.004 cm, or 16 percent of the PZT thickness. This allows the contact point to spread charge more widely than if no coating were present. The additional extra power dissipation can be managed by preventing the coating resistivity from being too low. In addition, the semiconductive coating can provide sufficient charge diffusivity to allow the piezoelectric material to be poled in an assembled print module. This can allow a separate metallization step to be avoided during manufacture, which can decrease the expense of manufacture. Because poling can take place later in the manufacturing process, manufacturing processes that were previously avoided, for example, processes that involve temperatures above the Curie temperature or processes that otherwise might depole the piezoelectric material, can be employed. The semiconductive coating can allow a uniform voltage applied simultaneously via all of the electrodes on one surface of the piezoelectric element (i.e., the firing and ground electrodes together) to build up on that side for poling. For example, a coating having a resistivity of 100 megaohms per square on PZT having a thickness of 0.25 mm and a dielectric constant of $1600\times\epsilon_0$ has a diffusivity is 1.7 $cm^2$/sec. If the distance between the ground plane and the electrode is 0.025 cm, the region can attain a poling voltage in a fraction of a second.

In a similar manner, individual electrode access to a jetting region can allow a poling adjustment to be made to a single jet to improve jetting performance, including ink droplet velocity and size. For example, by applying a voltage to an electrode for a particular jet, the semiconductive coating can enable the region of the jet to be poled or depoled to alter the jetting parameters of the particular jet being accessed. The jetting region includes the firing electrode, the adjacent ground electrode, and the gap between the electrodes. A different voltage could be applied to each electrode to selectively control the local poling voltage, thereby changing the jetting properties. During manufacture, jet properties such as droplet volume or velocity can be measured and a modification voltage can be applied to the particular jet in order to more closely match the jetting performance of the other jets. In this way, performance of each jet of the module can be tailored by changing the degree of poling in the jetting region. The method can be implemented on modules described above, as well as modules in which each jet has its own fire and ground electrodes, which permits the ground and the fire electrodes for a given jet to be placed at the same potential for poling or depoling.

Figure 4:
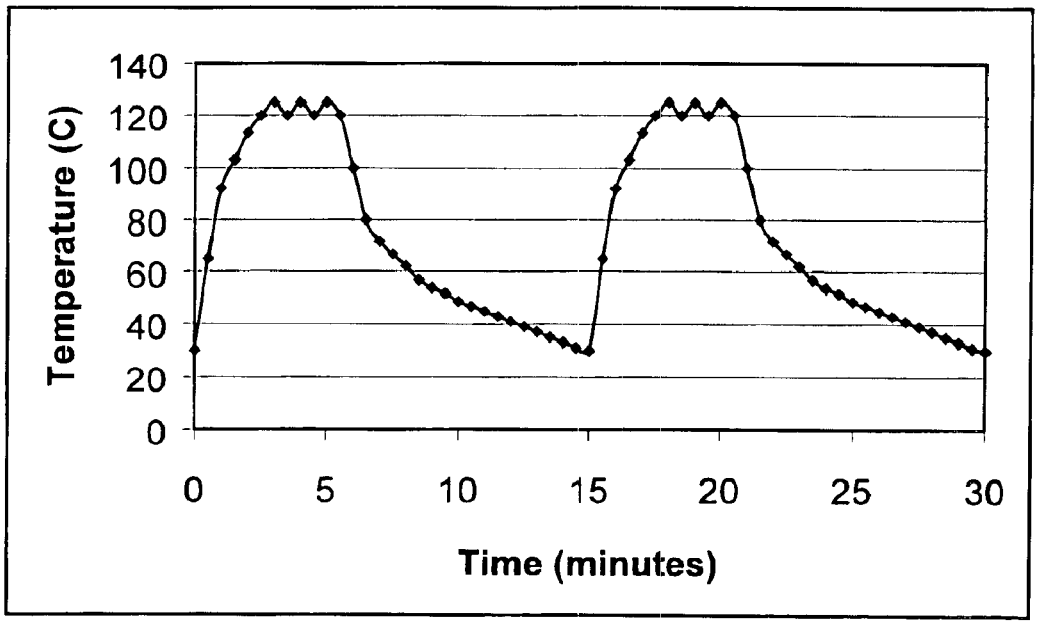
FIG. 4 is a graph depicting the temperature of a piezoelectric ink jet printing module during heating and cooling cycles.
Figure 5:
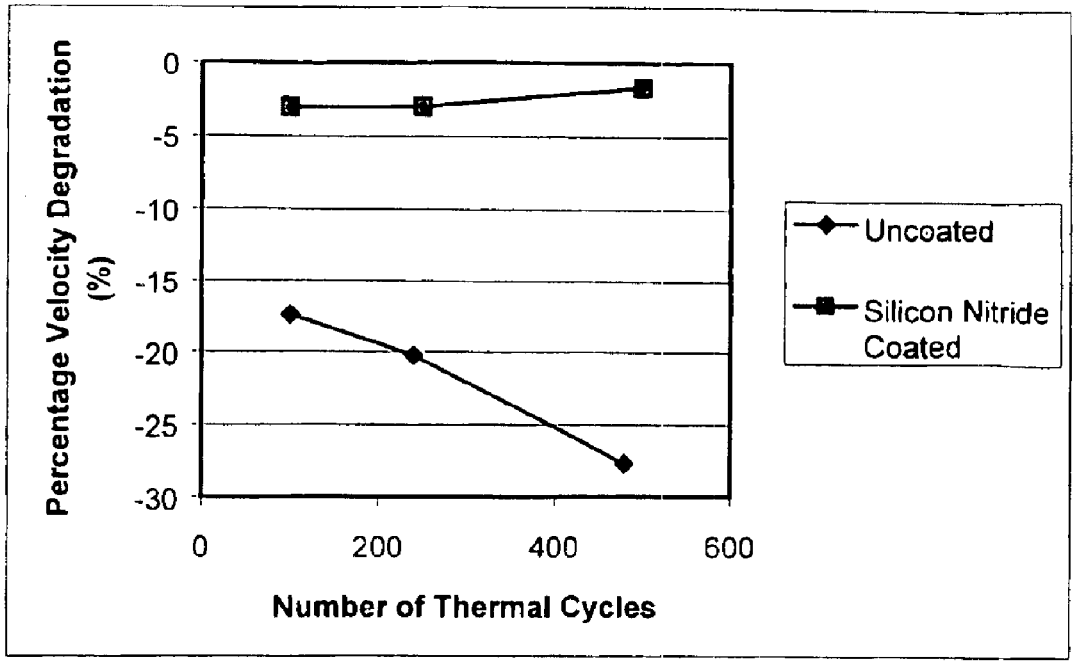
FIG. 5 is a graph depicting the percent decrease in droplet velocity after repeated heating and cooling cycles for a piezoelectric ink jet printing module and a piezoelectric ink jet printing module having a semiconductive coating on the piezoelectric element.

The droplet velocity degradation upon thermal cycling was measured for a PZT-based print head that did not have a semiconductive coating and a PZT-based print head that had a silicon nitride-based semiconductive coating on the piezoelectric element. The silicon nitride coating was deposited by plasma enhanced chemical vapor deposition, had a Si/N mole ratio of about 2, and a thickness of 5000 Angstroms. The carbon print head assemblies of each device, which each had a mass of about 200 grams, were subjected to repeated thermal cycling to temperatures that can generate significant pyroelectric charge on the PZT. Specifically, the thermal cycles followed temperature profile shown in FIG. 4. The print head assemblies were heated for three minutes from room temperature to 125° C. The elevated temperature was maintained for a dwell time at temperature of three minutes and the assemblies were cooled over a nine minute period using fan forced air. Droplet velocity was measured for each assembly at the beginning of the test and at regular intervals during the test. The data showing the percent degradation in velocity (100×(test velocity−initial velocity)/initial velocity) for the uncoated assembly and the coated assembly are shown in FIG. 5. The coated assembly was more stable to thermal cycling than the uncoated assembly.

A number of embodiments of the invention have been described. Nevertheless, it will be understood that various modifications may be made without departing from the spirit and scope of the invention. For example, the semiconductive coating can be formed from any semiconductive material having an appropriate resistivity. The semiconductive material can be an inorganic material, such as silicon nitride, as described above, or an organic material. Accordingly, other embodiments are within the scope of the following claims.

What is claimed is:

1. A method of reducing ink velocity degradation in an ink jet module during thermal cycling comprising placing a semiconductive material in physical contact with a surface of a piezoelectric element thereby reducing a pyroelectric charge on the surface of the piezoelectric element.

2. The method of claim 1, wherein placing includes coating the semiconductive material on the piezoelectric element.

3. The method of claim 1, wherein the semiconductive material has a resistivity of 0.1 megaohms per square or greater.

4. The method of claim 1, wherein the semiconductive material has a resistivity of 5000 megaohms per square or less.

5. The method of claim 1, wherein the semiconductive material of each module has a diffusivity of between 0.006 and 100 $cm^2$/sec.

6. The method of claim 1, wherein the semiconductive material of each module is derived from silicon nitride, alumina, or neodymium oxide.

7. The method of claim 1, wherein the piezoelectric element of each module is lead zirconium titanate.

8. A method of poling a piezoelectric ink jet module comprising:

assembling a piezoelectric ink jet module including a semiconductive material in physical contact with a surface of a piezoelectric element, the piezoelectric element having electrical contacts in contact with the semiconductive material on the surface of the piezoelectric element, the electrical contacts arranged to activate the piezoelectric element, and applying a poling voltage across the semiconductive material and the piezoelectric element for sufficient time to pole the piezoelectric element.

9. The method of claim 8, wherein semiconductive material has a resistivity of 5000 megaohms per square or less.

10. The method of claim 8, wherein the semiconductive material has a resistivity of 0.1 megaohms per square or greater.

11. The method of claim 8, wherein the semiconductive material is a coating between 1000 and 10000 Angstroms thick.

12. The method of claim 8, wherein the piezoelectric element is lead zirconium titanate.

13. The method of claim 8, wherein the semiconductive material is derived from silicon nitride, alumina, or neodymium oxide.

14. The method of claim 8, wherein the semiconductive material is a coating on the piezoelectric element.

15. The method of claim 8, wherein the semiconductive material of each module has a diffusivity of between 0.006 and 100 $cm^2$/sec.

16. A method of modifying performance of a jet in an ink jet printing module comprising:

applying a modification voltage to a jetting region of a piezoelectric element of the ink jet printing module to increase or decrease polarization of the piezoelectric element in the jetting region.

17. The method of claim 16, wherein the jetting region includes an electrical contact contacting a semiconductive material on a surface of the piezoelectric element in the jetting region, and the modification voltage is applied to the electrical contact.

18. The method of claim 16, wherein the module includes a plurality of jets and each jet having a jetting region including an electrical contact contacting a semiconductive material on a surface of the piezoelectric material.

19. The method of claim 16, further comprising monitoring the jet of the module for ink drop size or ink drop velocity and selecting a modifying voltage to adjust the ink drop size or the ink drop velocity.

20. The method of claim 16, wherein the semiconductive material is a coating on the piezoelectric element.

21. The method of claim 16, wherein the semiconductive material of each module is derived from silicon nitride, alumina, or neodymium oxide.

22. The method of claim 16, wherein the piezoelectric element of each module is lead zirconium titanate.

* * * * *